US006595769B2

(12) United States Patent
Watanabe

(10) Patent No.: US 6,595,769 B2
(45) Date of Patent: Jul. 22, 2003

(54) COMBUSTION BURNER AND MIXER FOR COMBUSTION BURNER

(76) Inventor: Masahiro Watanabe, 3-15-12 Narimasu, Itabashi-ku, Tokyo (JP)

( * ) Notice: Subject to any disclaimer, the term of this patent is extended or adjusted under 35 U.S.C. 154(b) by 0 days.

(21) Appl. No.: 09/901,262

(22) Filed: Jul. 9, 2001

(65) Prior Publication Data

US 2003/0008252 A1 Jan. 9, 2003

(51) Int. Cl.[7] ..... F23J 7/00

(52) U.S. Cl. ..... 431/4; 110/262

(58) Field of Search ..... 110/262; 431/4, 431/190; 261/18.2

(56) References Cited

U.S. PATENT DOCUMENTS 4,425,854 A * 1/1984 Calfo et al. ..... 110/262

* cited by examiner

*Primary Examiner*—Henry Bennett
*Assistant Examiner*—S. Dagostino
(74) *Attorney, Agent, or Firm*—Jordan and Hamburg LLP

(57) ABSTRACT

A combustion burner includes a nozzle body formed in the shape of a pipe having an jet hole and a fuel nozzle installed into the nozzle body including an air jet hole, and having a fuel supply passage supplies fuel from the tip portion of the fuel nozzle. The combustion burner further includes an air supply case which conducts air to the air jet hole. A mixing device is installed into the air supply case so that water and oil including light oil, heavy oil and the like are mixed by a simple mixer while flowing towards the fuel nozzle, and mixed fuel is burned at lower cost without dissociation or the need for expensive equipment.

7 Claims, 15 Drawing Sheets

COMBUSTION BURNER AND MIXER FOR COMBUSTION BURNER

BACKGROUND OF THE INVENTION

This invention is related to a combustion burner and mixer for a combustion burner which burns fuel including light oil and heavy oil.

When burning heavy oil, especially C heavy oil and other similar oil conventionally, water and emulsifier are added to the C heavy oil and a churning mixture is carried out by using an expensive churning mixer to produce a fuel mixture, which is supplied into a combustion burner by using a fuel supply pipe and burned.

Since C heavy oil and water are mixed using an emulsifier, the conventional combustion method involves high cost. Also, an expensive churning mixer is needed, and the heavy oil, especially C heavy oil, cannot be freely used as fuel in the conventional combustion method.

Moreover, since the mixture is supplied from the churning mixer to the combustion burner using the fuel supply pipe, the mixture of C heavy oil and water dissociates while being supplied, and the combustion becomes inefficient.

SUMMARY OF THE INVENTION

In the light of the foregoing, it is an object of the present invention to provide a combustion burner and mixer for a combustion burner in which water and oil including light oil, heavy oil and so on are mixed by simple mixture and the mixed fuel is burned at lower cost without dissociation.

It is another object of the present invention to provide a combustion burner and a mixer for a combustion burner which obviates the need for the expensive equipment heretofore conventionally required and which can be used freely.

The novel features which are believed to be characteristic of the invention, both as to its organization and method of operation, together with further objects and advantages thereof, are described below with reference to the accompanying drawings in which a preferred embodiment of the invention is illustrated as an example.

It is to be expressly understood, however, that the drawings are for the purpose of illustration and description only, and are not intended as a definition of the limits of the invention.

DETAILED DESCRIPTION OF THE INVENTION

Figure 1:
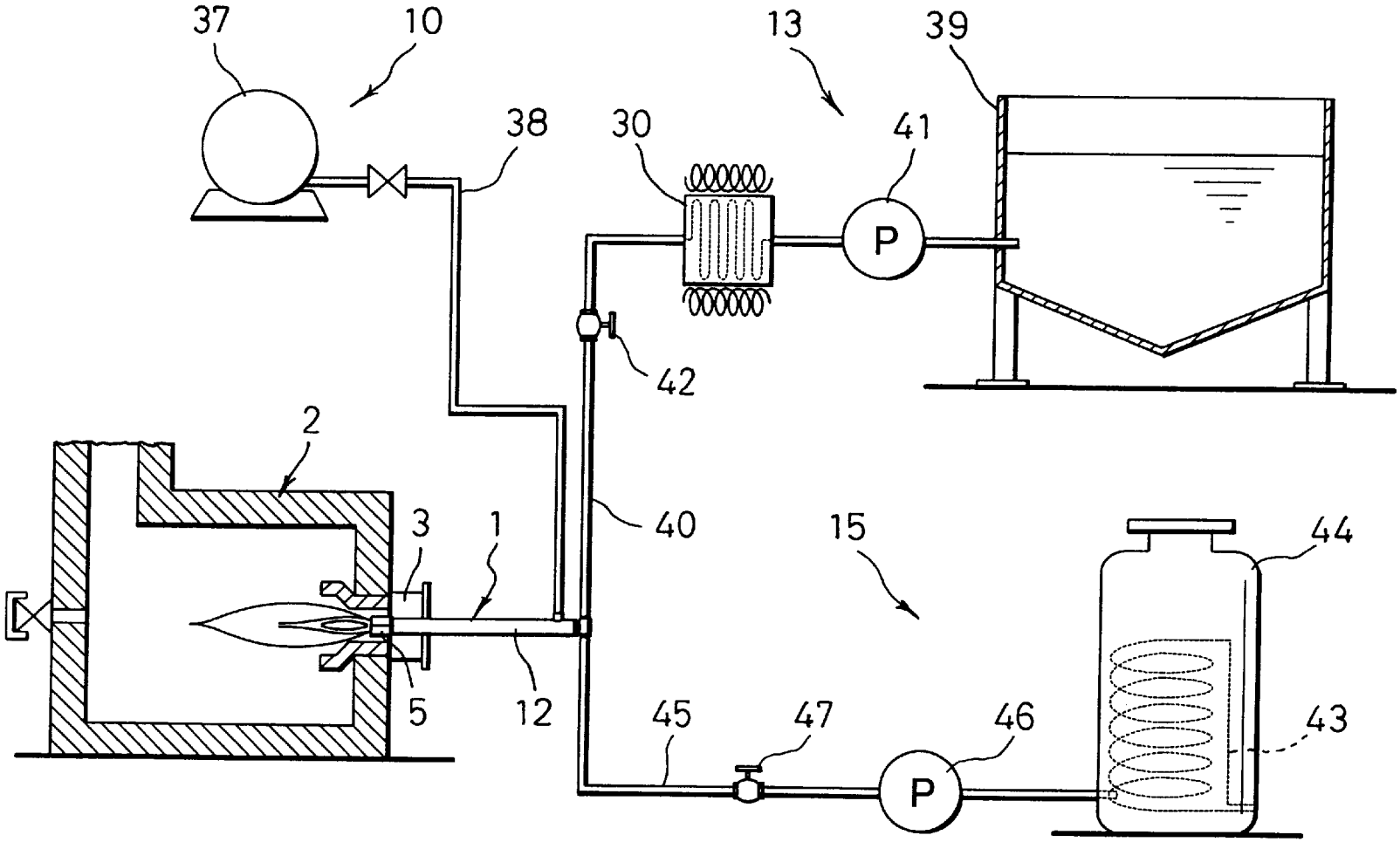
FIG. 1 is an explanation view in use showing a first embodiment of the present invention.
Figure 2:
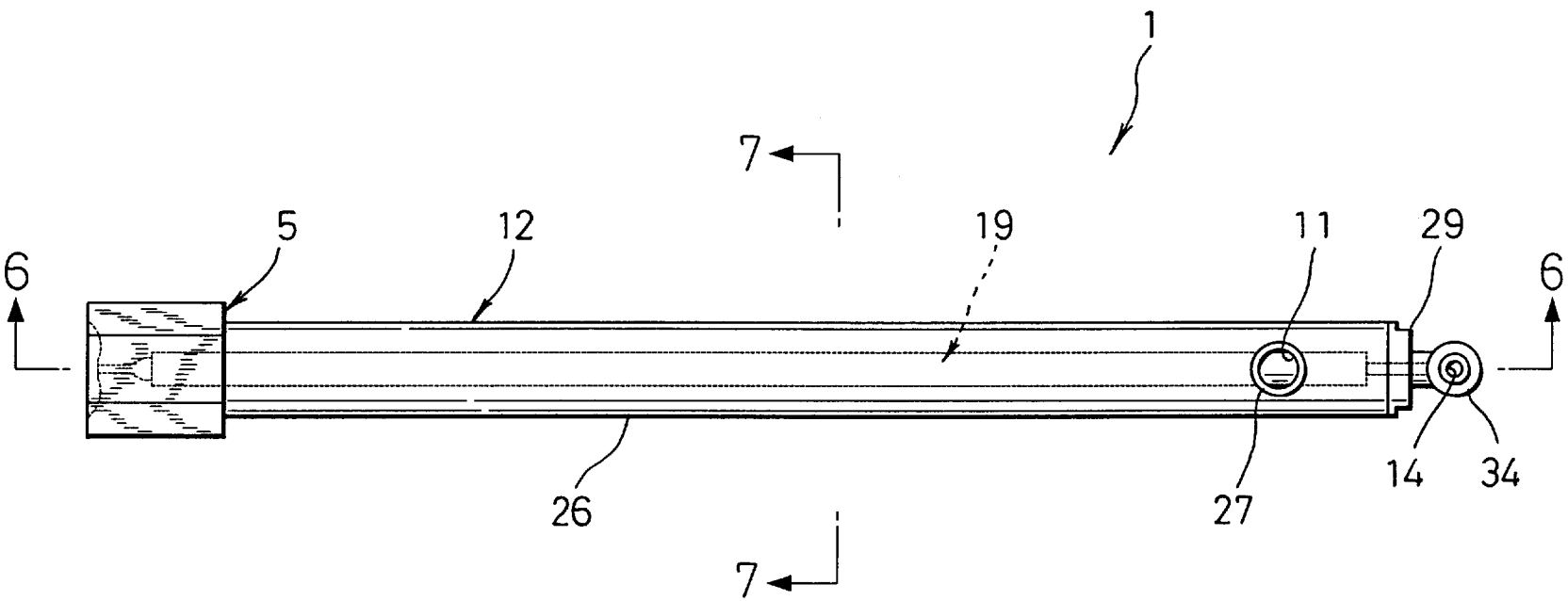
FIG. 2 is a side view showing the first embodiment of the present invention.
Figure 3:
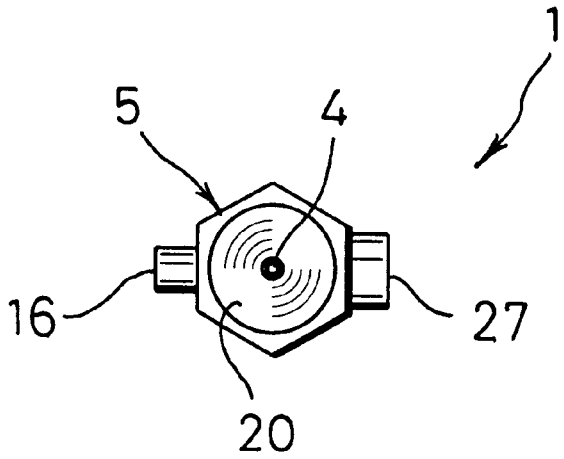
FIG. 3 is a front view showing the first embodiment of the present invention.
Figure 4:
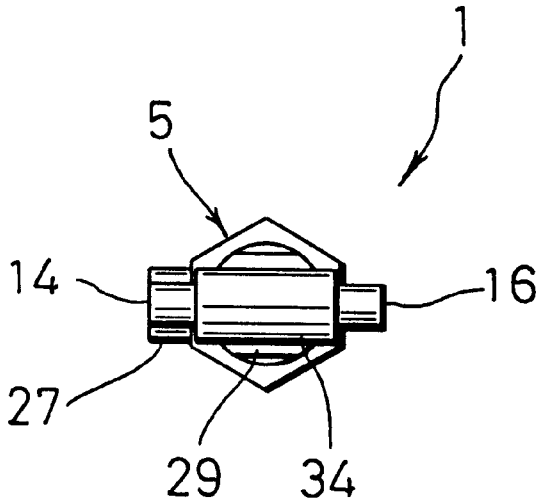
FIG. 4 is a back view showing the first embodiment of the present invention.
Figure 5:
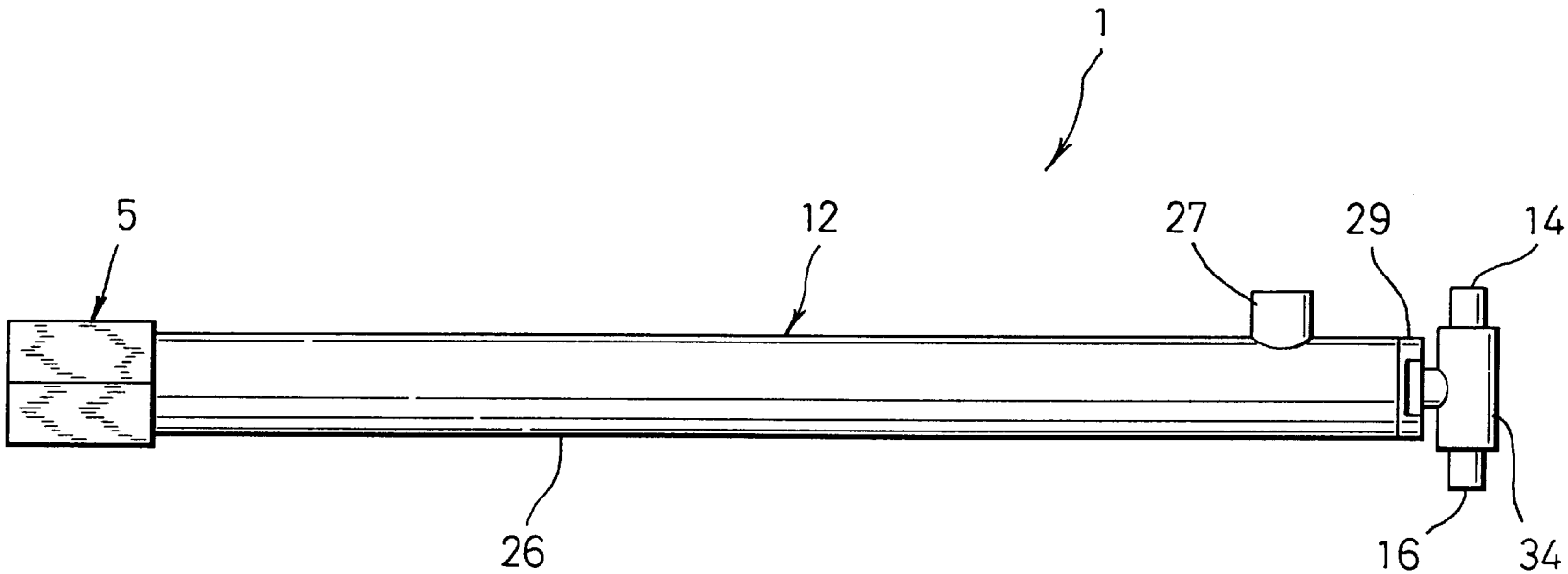
FIG. 5 is a bottom view showing the first embodiment of the present invention.

Preferred embodiments of the present invention are described in more detail below referring to the accompanying drawings.

An understanding of the present invention may be best gained by reference FIGS. 1 to 12. FIGS. 1 to 12 illustrate a first embodiment of the present invention wherein a combustion burner 1 is used to attach to an attachment 3 of the combustion burner 1 in a combustion furnace 2, such as, for example, a boiler.

The combustion burner 1 is comprised of a nozzle body 5 formed in the shape of a pipe and made from metal material, a fuel nozzle 9 installed into the nozzle body 5, an air supply case 12, and a mixer 19 which operates as a mixing device installed into the air supply case 12.

A jet hole 4 is formed in a central part of the nozzle body 5.

Figure 9:
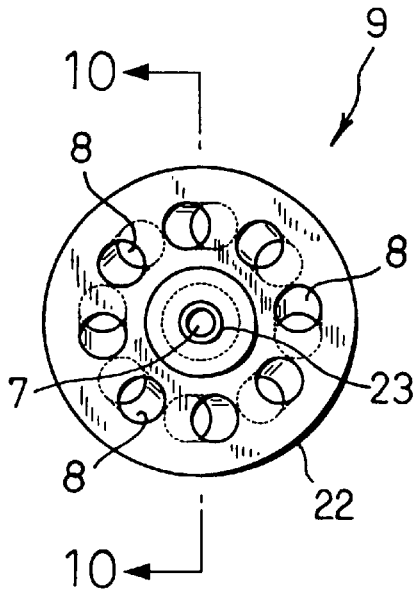
FIG. 9 is a front view of the nozzle body showing the first embodiment of the present invention.
Figure 10:
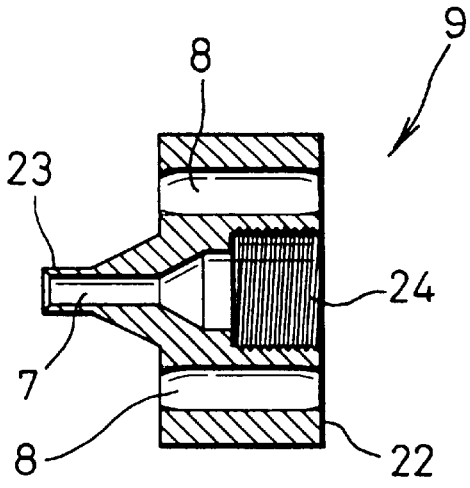
FIG. 10 is a cross sectional view taken along a line 10—10 of FIG. 7.

The fuel nozzle 9, as depicted in FIGS. 9 and 10, includes an air jet hole 6, formed in the shape of a ring, placed between a tip perimeter part of the nozzle 9 and the jet hole 4. A fuel supply passage 7 supplies fuel from the tip portion of the fuel nozzle 9, and a plurality of spiral air guide holes 8 are provided at an outer circumferential portion of the fuel nozzle 9 so as to supply spiral air to the air jet hole 6.

Figure 6:
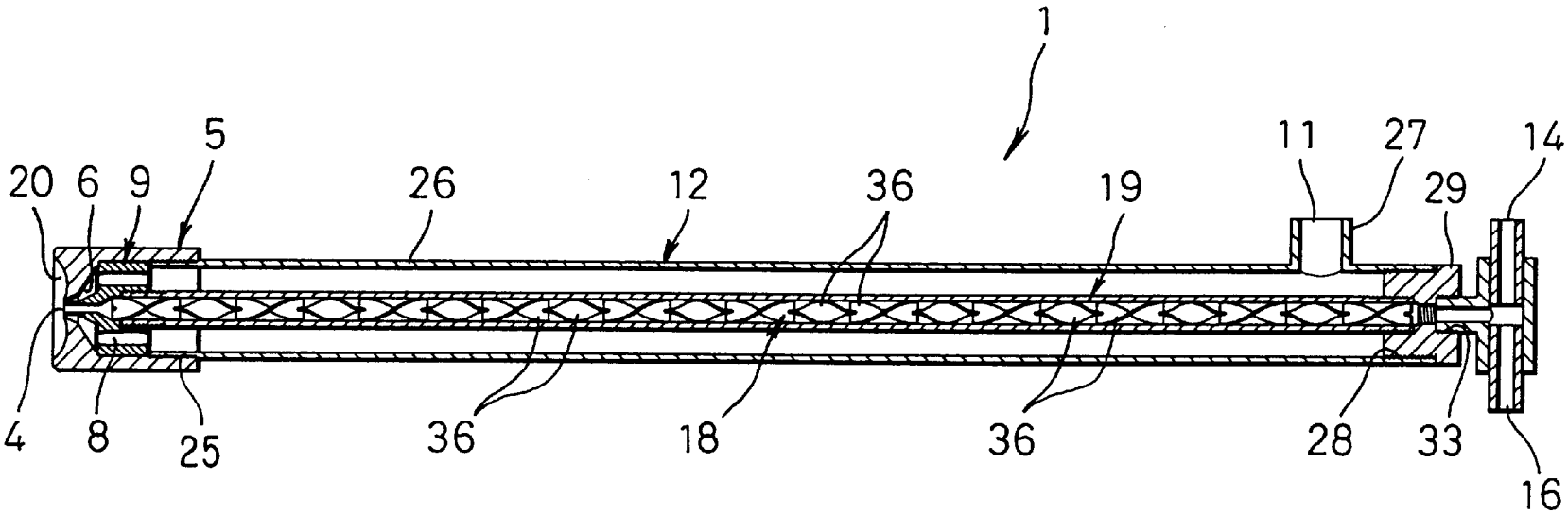
FIG. 6 is a cross sectional view taken along a line 6—6 of FIG. 2.
Figure 7:
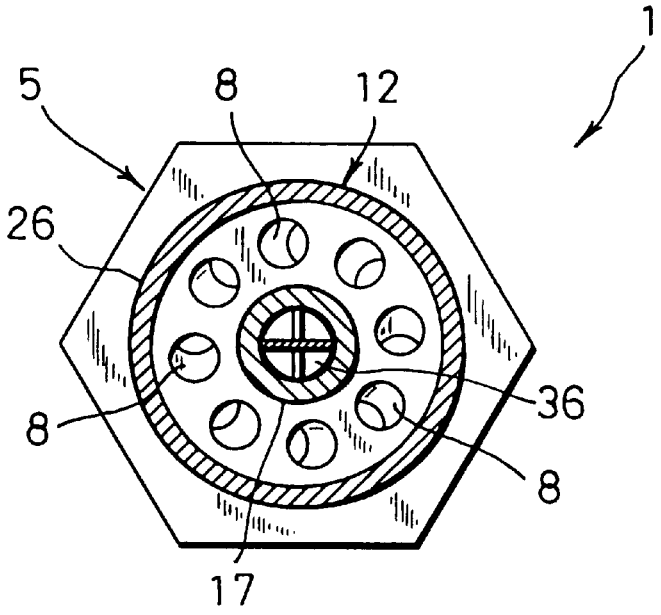
FIG. 7 is a cross sectional view taken along a line 7—7 of FIG. 2.

As best seen in FIG. 6, one end part of the air supply case 12 is fixed to the nozzle body 5, and the air supply mouth 11 connected to an air supply 10 is formed at the part adjacent another end of the air supply case 12.

The mixer 19 consists of a fuel supply pipe 17 and a mixer body 18. One end part of the fuel supply pipe 17 is connected to the fuel supply passage 7 of the fuel nozzle 9, and another end thereof includes a water supply mouth 14 connected to a water supply 13 and a fuel supply mouth 16 connected to a fuel supply 15 which supplies light oil, heavy oil and the like. The mixer body 18 is installed into the fuel supply pipe 17 and mixes water and fuel by the flow of water and fuel which passes through the fuel supply pipe 17.

Figure 8:
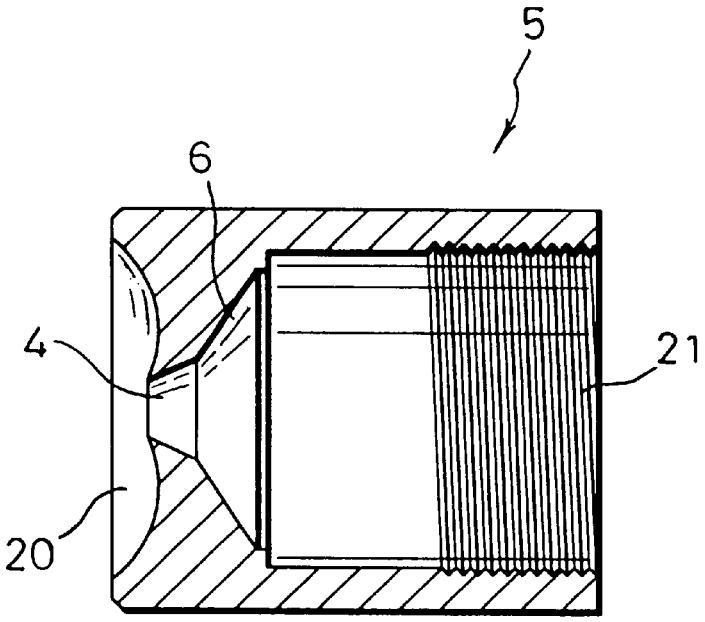
FIG. 8 is an explanation view of a nozzle body showing the first embodiment of the present invention.

The nozzle body 5 is formed from metal material, such as, for example, heat-resistant and acid-proof stainless steel. As shown in FIG. 8, a tip part thereof forms in arc-shaped concave portion 20, the jet hole 4 is formed at the central part of the concave portion 20, the screw part 21 is formed at the inner wall in the rear portion thereof.

As shown in FIGS. 9 and 10, the fuel nozzle 9 is comprised of a fuel nozzle body 22 installed into the nozzle body 5 (not shown) and formed in the shape of a pillar. A nozzle 23 projects from the central portion at the front of the fuel nozzle body 22 and which is inserted into the jet hole 4 (FIG. 8). The fuel supply passage 7 is formed at a central portion positioned between the nozzle 23 and fuel nozzle body 22. A thread portion 24 for attaching to the mixer 19, is formed at the inner wall at the side of the back of the fuel supply passage 7, and the air guide holes 8 which supply spiral air are provided at predetermined intervals on the outer circumferential portion of the fuel nozzle body 22.

The air supply case 12, as shown in FIG. 6, comprises an air supply case body 26 formed in the shape of a pipe, an end portion thereof having a thread portion 25 screwed onto the thread portion 21 of the nozzle body 5. An air connection pipe 27 as the air supply mouth 11 is formed at a portion adjacent an opposite end of the air supply case body 26, and a blockade stopper 29 is screwed onto a thread portion 28 formed at the opposite end of the air supply case body 26.

Figure 11:
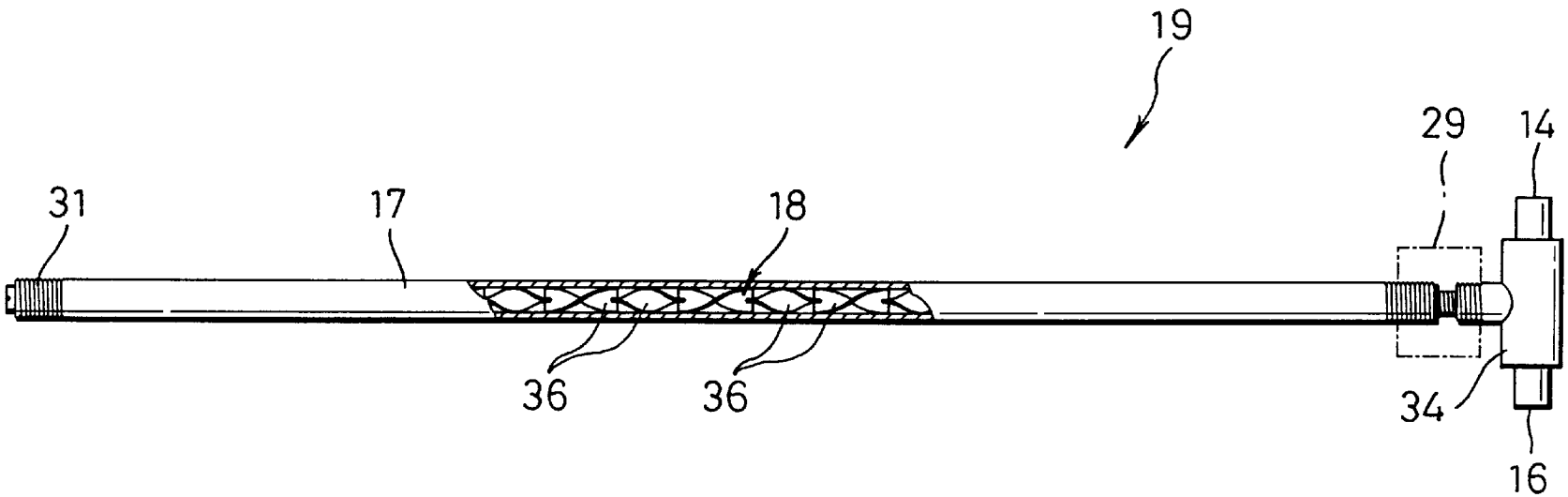
FIG. 11 is an explanation view of a mixture showing the first embodiment of the present invention.
Figure 12:
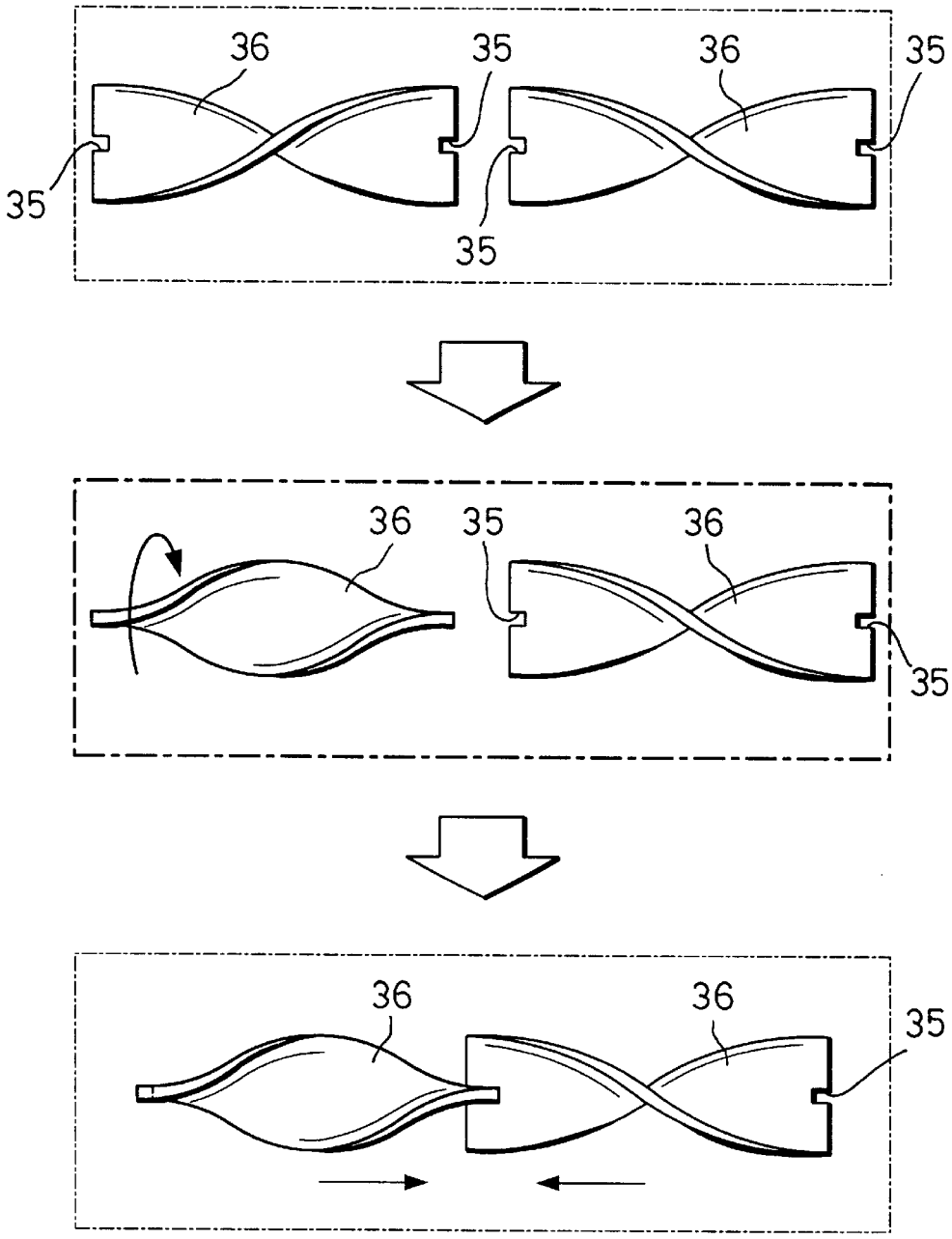
FIG. 12 is an explanation view of a guide board showing the first embodiment of the present invention.
Figure 13:
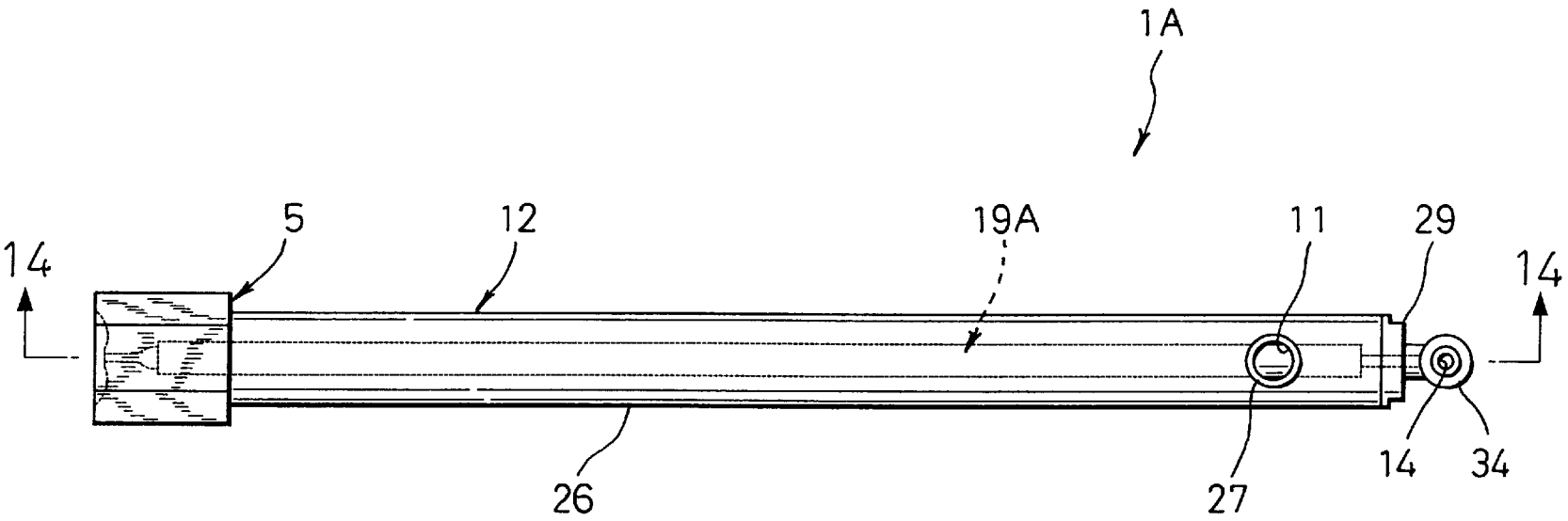
FIG. 13 is a side view showing a second embodiment of the present invention.
Figure 14:
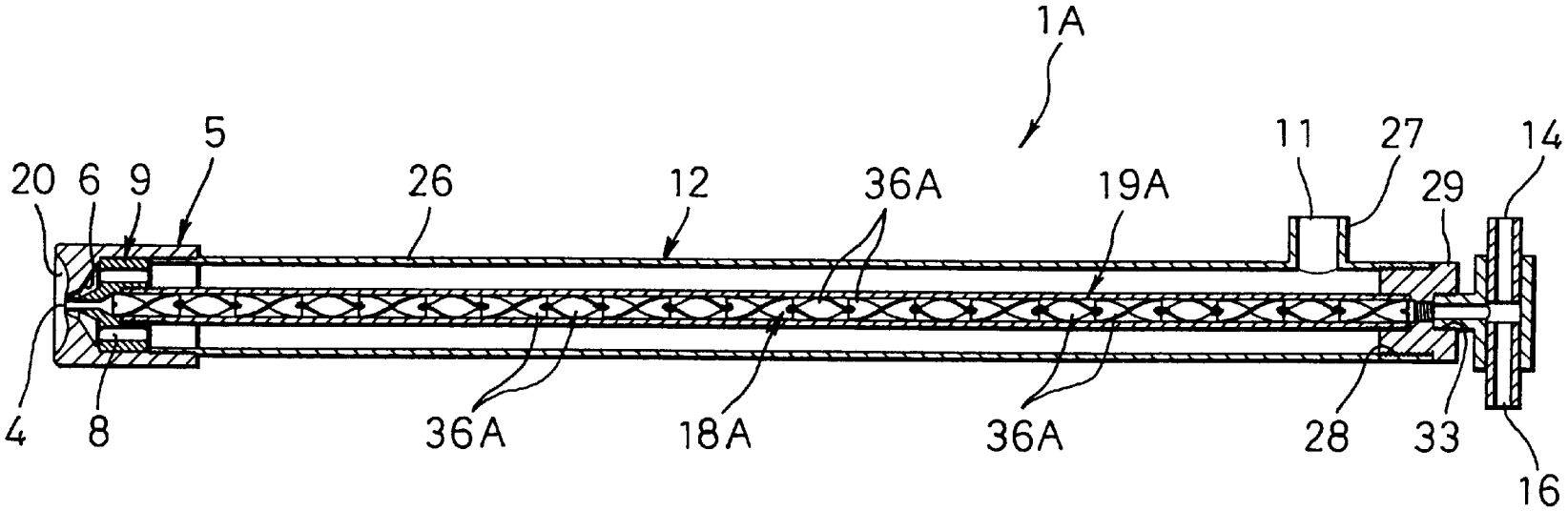
FIG. 14 is a cross sectional view taken along a line 14—14 of FIG. 13.
Figure 15:
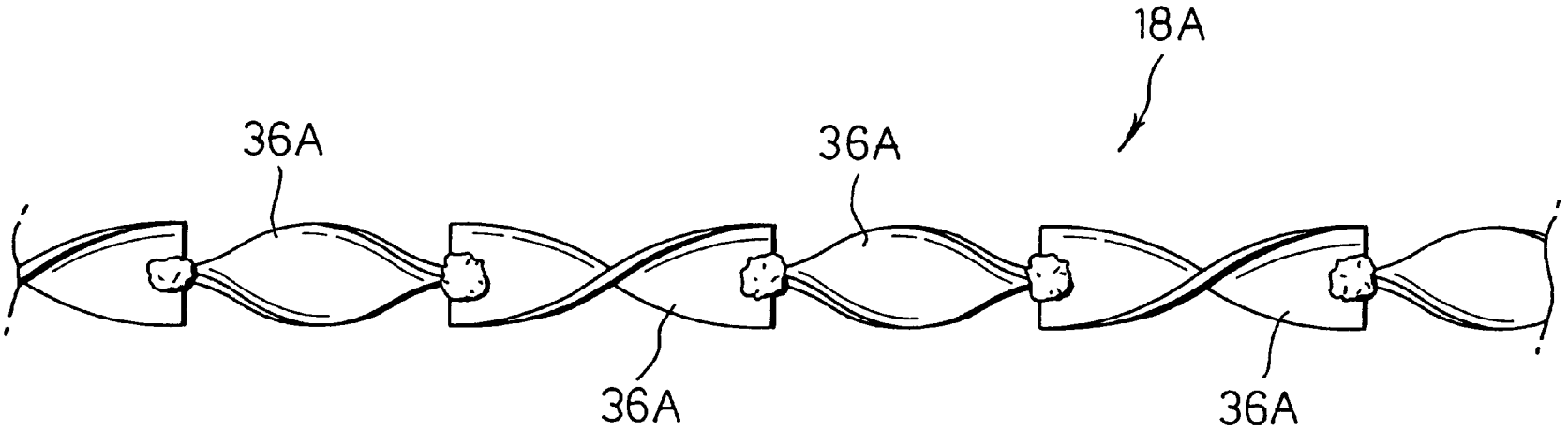
FIG. 15 is an explanation view of a mixture showing the second embodiment of the present invention.
Figure 16:
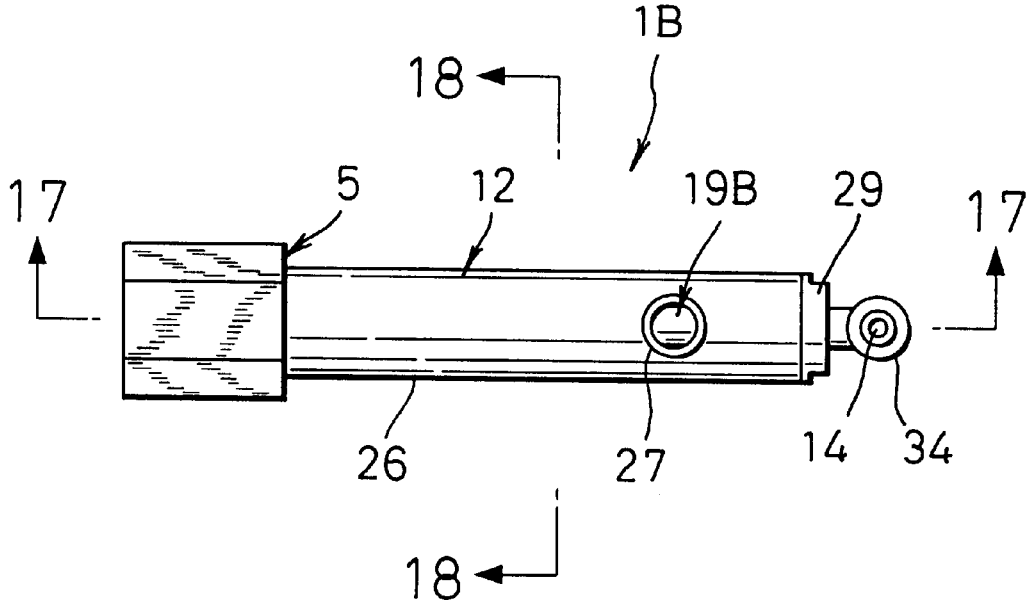
FIG. 16 is a side view showing a third embodiment of the present invention.
Figure 17:
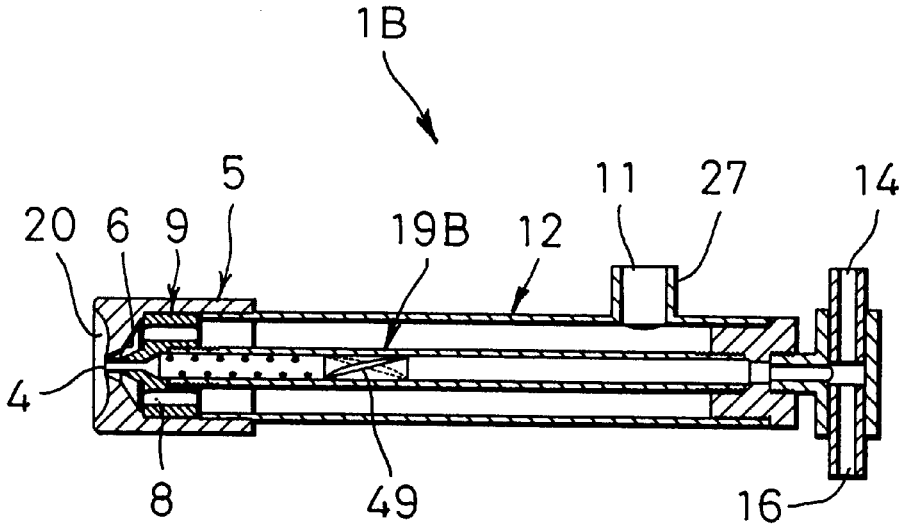
FIG. 17 is a cross sectional view taken along a line 17—17 of FIG. 16.
Figure 18:
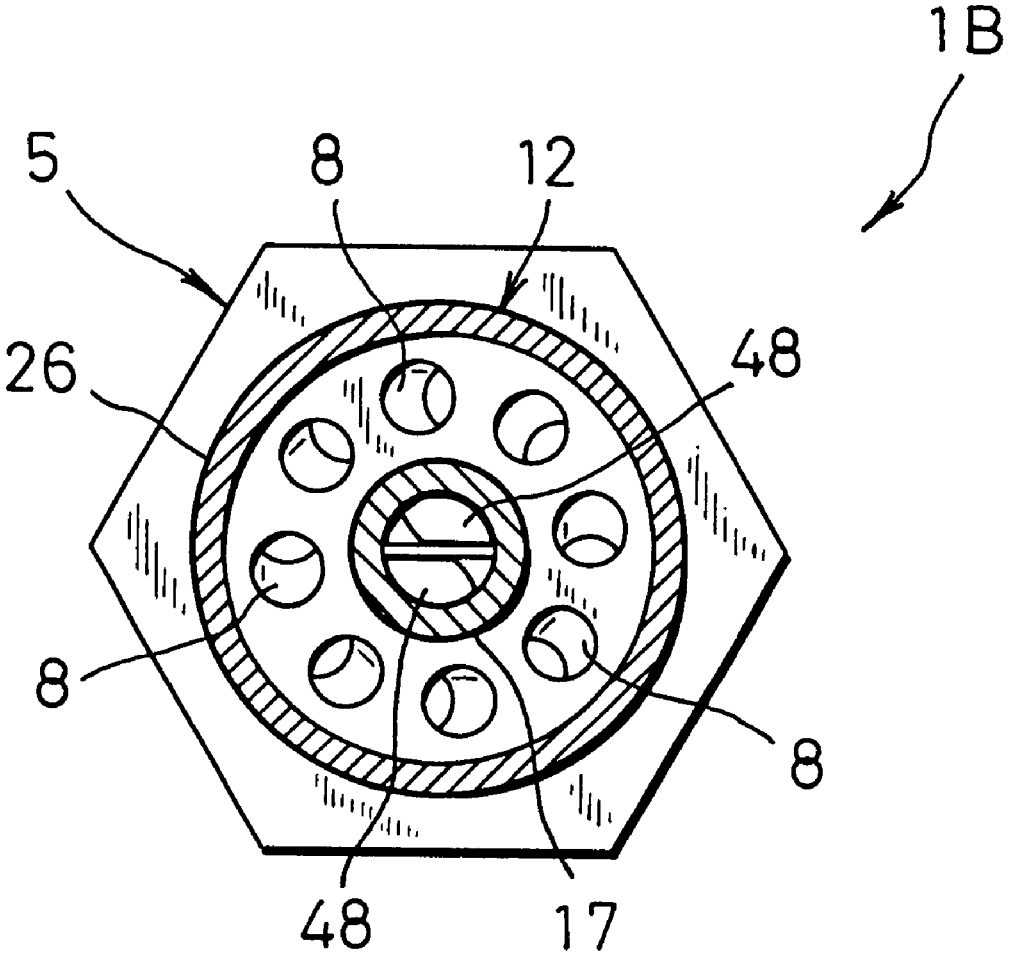
FIG. 18 is a cross sectional view taken along a line 18—18 of FIG. 16.
Figure 19:
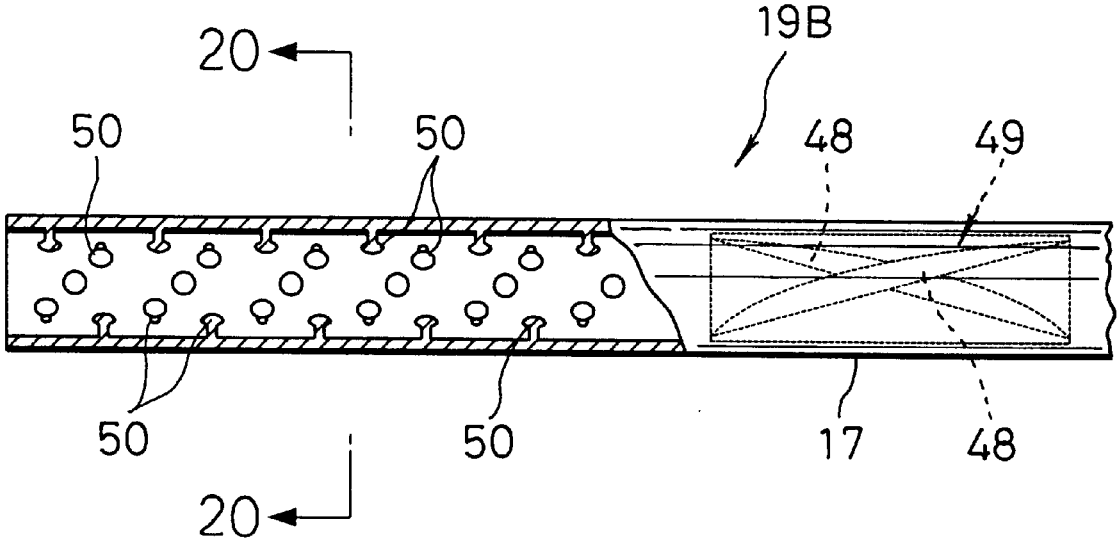
FIG. 19 is an explanation view of a mixture showing the third embodiment of the present invention.
Figure 20:
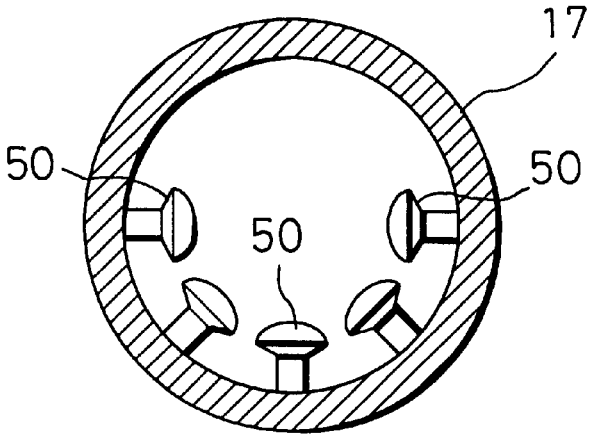
FIG. 20 is a cross sectional view taken along a line 20—20 of FIG. 19.

As shown in FIG. 11, the mixer 19 is comprised of the fuel supply pipe 17 having a thread portion 31 formed at one end thereof which screws into the thread portion 24 of the fuel nozzle 9, and having an opposite end thereof screwed onto a thread hole 32 formed at a central portion of the blockade stopper 29; an elbow 34 connected to the back end portion of the fuel supply pipe 17 which includes the water supply mouth 14 and fuel supply mouth 16; and a mixer body 18 installed into the fuel supply pipe 17 bent metal plates, such as stainless steel, of the shape of a rectangle, connected as a plurality of guide boards 36 each having a fitting 35 formed at a central portion at both ends thereof respectively, as shown in FIG. 12.

Referring again to FIG. 1, the air supply 10 consists of a blower 37 and an air supply hose 38 which connects to the air connection pipe 27 of combustion burner 1 so as to supply air from the blower 37.

The water supply 13 comprises a water supply hose 40 which can lead the water of a tank or the pollution tub 39 to the water supply mouth 14 of the combustion burner 1; the pump 41 interposed to the water supply hose 40; a heater 30 which can heat water at about 70 degrees C.; and an opening-and-closing valve 42.

The fuel supply 15 consists of a fuel tank 44 with heating equipment 43 which can heat fuel, such as, heavy oil at about 70 degrees C.; a fuel supply hose 45 which leads the fuel from the fuel tank 44 to the fuel supply mouth 16 of the combustion burner 1; and a pump 46 and an opening-and-closing valve 47 interposed between the fuel supply hose 45.

In the combustion burner 1, the air supplied from the air supply equipment 10 passes through the air guide holes 8 of the nozzle 9 from the inside of the air supply case 12 and is jetted in a swirl form from the air jet hole 6.

Moreover, although fuel jets in the state of suction by jetting of the air of the shape of swirl from the fuel supply passage 7 of the fuel nozzle 9, water and fuel including heavy oil supplied from the water supply equipment 13 and the fuel supply equipment 15, is mixed by being divided by two in the connection portion of the guide boards 36 of the body 18 of the mixer. The fuel mixture is jetted from the nozzle body 5 in the state in which flow to the nozzle body 5 of water and oil one by one and efficiently mixed, so that it can burn at an emulsion burning state, creating combustion which prevents generation of isolation carbon and nitrogen oxide.

Other embodiments of the present invention will now be described referring to FIGS. 13 to 20. Through the drawings of the embodiments, like components are denoted by like numerals as of the first embodiment and will not be further explained in great detail.

A second embodiment of the present invention is shown in FIGS. 3 to 15. It is distinguished from the first embodiment by the fact that the mixer 19 is replaced from another device 19A having a mixer body 18A welded and fixed so as to position a plurality of guide plates 36A at right angles with one another. A combustion burner 1A with the mixer 19A according to second embodiment have similar advantages to those according to the first embodiment, except for high cost.

A third embodiment of the present invention is shown in FIGS. 16 to 20. It is distinguished from the first embodiment by the fact that the mixer 19 is replaced from another device 19B including a guide vane chamber 49 with guide vanes 48, 48 and an OHR line mixer having mushroom shaped current cutters formed in an inner wall thereof. By virtue of such configuration, heavy matters move towards the external portion, light matters towards the internal portion of the reactor due to a violent centrifugal force, and layers collides with the current cutter which induce the layer mixing and particle breaking. A combustion burner 1B with the mixer 19B according to the third embodiment has similar advantages to those according to the first embodiment.

As set forth above, the advantages of the invention are as follows:

(1) A combustion burner has a nozzle body formed in the shape of a pipe, having a jet hole formed in a central part of the nozzle body; a fuel nozzle installed into the nozzle body, including an air jet hole formed in the shape of a ring and placed between a tip perimeter part of the nozzle and the jet hole, having a fuel supply passage supplies fuel from the tip portion of the fuel nozzle; an air supply case including one end part thereof fixed to the nozzle body, and an air supply mouth connected to an air supply equipment is formed at the part adjacent another end of the air supply case; and a mixing device installed into the air supply case and further including a fuel supply pipe connected to the fuel supply passage of the fuel nozzle, another end thereof provided a water supply mouth connected to a water supply equipment and a fuel supply mouth connected to a fuel supply equipments which supplies one of light oil and heavy oil and a mixing device body installed into the fuel supply pipe which mixes water and fuel by the flow of water and fuel which passes through the fuel supply pipe so that the mixing device mixes water and fuel including light oil, heavy oil and so on, and it can be supplied into the nozzle body directly. Therefore, water and an oil ingredient are not separated, and it can be made to burn reliably.

(2) As discussed above, since water, light oil, and heavy oil are mixed by the mixing device, it is not necessary to use an expensive churning mixer as heretofore required, or to maintain a mixed state using an emulsifier, and can be practiced at low cost.

(3) As discussed above, since water is added to fuel including light oil, heavy oil and so on, it can be burned in the state where it can prevent generation of nitrogen oxide efficiently.

(4) As discussed above, the conventionally unsuitable fuel for combustion, such as C heavy oil, can be freely used as fuel.

(5) As discussed above, in accordance with an advantageous embodiment of the invention, it is easy to reduce the cost, have a simple structure and attain optimal miniaturization, since the guide boards are connected by a fitted fixation.

What is claimed is:

1. A combustion burner, comprising:

a generally pipe-shaped nozzle body having a jet hole formed in a central part of the nozzle body;

a fuel nozzle installed into the nozzle body, said fuel nozzle including a generally ring-shaped air jet hole positioned between a tip perimeter part of the nozzle and the jet hole, said fuel nozzle further including a fuel supply passage through which fuel to be expelled from a tip portion of the fuel nozzle is supplied thereto;

an air supply case including one end part thereof fixed to the nozzle body, and an air supply mouth formed at a part adjacent another end of the air supply case for connection to an air supply; and a mixing device installed into the air supply case, including a fuel supply pipe connected to the fuel supply passage of the fuel nozzle, another end thereof being provided with a water supply mouth connected to a water supply and a fuel supply mouth connected to a fuel supply which supplies one of light oil and heavy oil and a mixing device body installed into the fuel supply pipe which mixes water and fuel by operation of the flow of the water and fuel which passes through the fuel supply pipe.

2. A combustion burner, comprising:

a generally pipe-shaped nozzle body having a jet hole formed in a central part of the nozzle body;

a fuel nozzle installed into the nozzle body, said fuel nozzle including a generally ring-shaped airjet hole positioned between a tip perimeter part of the fuel nozzle and the jet hole, said fuel nozzle further including a fuel supply passage through which fuel to be expelled from a tip portion of the fuel nozzle is supplied thereto;

an air supply case including one end part thereof fixed to the nozzle body, and an air supply mouth being formed at a part adjacent another end of said air supply case for connection to an air supply; and a mixing device installed into the air supply case, including a fuel supply pipe connected to the fuel supply passage of the fuel nozzle, another end thereof being provided with a water supply mouth connected to a water supply and a fuel supply mouth connected to a fuel supply which supplies one of light oil and heavy oil, and a mixing device body installed within the fuel supply pipe which mixes water and fuel by the flow of water and fuel which passes through the fuel supply pipe, said mixing device body having a cross portion at a predetermined interval and spiral air guide holes provided at an outer circumferential portion of the fuel nozzle which allow jetting air supplied by the air supply case to exit the air jet hole.

3. A mixing device for a combustion burner, comprising;

a fuel supply pipe connected at one end thereof to a fuel supply passage in a combustion burner body;

an elbow provided with a water supply mouth connectable to an water supply, said elbow being connected to a rear end of the fuel supply pipe, said elbow further including a fuel supply mouth connectable to a fuel supply of one of light oil and heavy oil; and a mixing device body installed into the fuel supply pipe, said mixing device body being comprised of bent guide boards arranged to form a spiral so as to connect to cross respectively, water and fuel passing through said fuel supply pipe being mixed by flow thereof past said bent guide boards.

4. A mixing device for a combustion burner in which fuel is supplied through a fuel supply passage and expelled from a nozzle in communication therewith, the mixing device comprising;

a fuel supply pipe connectable at a first end thereof to the fuel supply passage and at a second end thereof to a water supply and a liquid fuel supply such that water and fuel can be simultaneously supplied to the fuel supply passage through said fuel supply pipe; and a mixing device body received within said fuel supply pipe, said mixing device body being configured to interfere with a flow of the water and the fuel introduced into said fuel supply pipe in such manner that the water and the fuel are mixed while passing through a region of said fuel supply pipe occupied by said mixing device body.

5. The mixing device according to claim 4, in combination with the combustion burner, said combustion burner including a nozzle having a centrally-positioned fuel jet hole in communication with said fuel supply passage and a generally annular air jet hole circumscribing said fuel jet hole through which air can be expelled.

6. The combination of claim 5, the combustion burner further comprising an air supply case connected at a first end thereof to the nozzle and including a passage through which air can be supplied from an air supply to the air jet hole, a second end of said air supply case being connectable to the air supply with said passage in communication therewith.

7. The combination of claim 5, wherein the fuel supply pipe is coaxially received within said air supply case.

* * * * *